US012129091B2

(12) United States Patent
Nilsson et al.

(10) Patent No.: US 12,129,091 B2
(45) Date of Patent: Oct. 29, 2024

(54) MESH CONTAINER AND METHOD FOR PRODUCING A MESH CONTAINER

(71) Applicant: Elfa International AB, Västervik (SE)

(72) Inventors: Peter Nilsson, Västervik (SE); Tobias Ringenhag, Västervik (SE)

( * ) Notice: Subject to any disclaimer, the term of this patent is extended or adjusted under 35 U.S.C. 154(b) by 270 days.

(21) Appl. No.: 17/355,122

(22) Filed: Jun. 22, 2021

(65) Prior Publication Data

US 2021/0394954 A1 Dec. 23, 2021

(30) Foreign Application Priority Data

Jun. 22, 2020 (SE) ..... 2050739-8

(51) Int. Cl.
*B65D 6/08* (2006.01)

(52) U.S. Cl.
CPC ..... *B65D 7/14* (2013.01)

(58) Field of Classification Search
CPC ..... B21D 31/04; A47B 88/90; A47B 88/906; B65D 7/14; B65D 7/16
See application file for complete search history.

(56) References Cited

U.S. PATENT DOCUMENTS

| | | | |
|---|---|---|---|
| 1,408,026 | A | 2/1922 | Ochiltree |
| 2,502,781 | A | 4/1950 | Erickson |
| 3,165,810 | A | 1/1965 | Agler |
| 4,205,406 | A | 6/1980 | Spector |
| 6,050,048 | A † | 4/2000 | Hellsten |
| 6,629,016 | B1 | 9/2003 | Smith |
| 6,700,059 | B1 | 3/2004 | Enmoto |
| 8,141,737 | B1 | 3/2012 | Tsai |
| D748,916 | S | 2/2016 | Nilsson |
| 9,398,819 | B2 | 7/2016 | Tsai |
| D766,634 | S | 9/2016 | Nilsson |
| D770,206 | S | 11/2016 | Nilsson |

(Continued)

FOREIGN PATENT DOCUMENTS

| | | |
|---|---|---|
| DE | 672476 | 3/1939 |
| DE | 672476 C | 3/1939 |

(Continued)

OTHER PUBLICATIONS

International Search Report and Written Opinion received in Patent Cooperation Treaty Application No. PCT/SE2016/051192, dated Feb. 28, 2017, 14 pages.

(Continued)

*Primary Examiner* — Moshe Wilensky
(74) *Attorney, Agent, or Firm* — Hubbard Law, PLLC; Marc A. Hubbard

(57) ABSTRACT

A mesh container two sets of opposing sides, a bottom, and a rim extending outwardly from the top of the sides is folded from one or more precursors cut from a web comprising a mesh portion formed by perforating and stretching part of a sheet and an unstretched portion. Each precursor is single piece that is folded into at least two side panels made at least partly of mesh and a portion of the outwardly extending rim made of the unstretched portion of the web. One or more portions for a bottom panel may be included with the two side panels, the bottom of the container being formed by folding the bottom panel portions away for the side panels to form an overlapping joint with each other.

12 Claims, 10 Drawing Sheets

(56) References Cited

U.S. PATENT DOCUMENTS

| | | | |
|---|---|---|---|
| D773,216 | S | 12/2016 | Nilsson |
| D775,467 | S | 1/2017 | Nilsson |
| 9,586,718 | B2 † | 3/2017 | Tsai |
| D784,745 | S | 4/2017 | Nilsson |
| D807,641 | S | 1/2018 | Nilsson |
| D808,269 | S | 1/2018 | Colombo |
| 9,869,115 | B2 | 1/2018 | Nilsson |
| 9,879,460 | B2 | 1/2018 | Nilsson |
| D819,732 | S | 6/2018 | Nilsson |
| D821,749 | S | 7/2018 | Nilsson |
| D823,622 | S | 7/2018 | Nilsson |
| 10,016,057 | B1 | 7/2018 | Arnautovic |
| 10,028,582 | B2 | 7/2018 | Nilsson |
| 10,051,958 | B2 | 8/2018 | Andersson |
| 10,104,959 | B2 | 10/2018 | Nilsson |
| D839,029 | S | 1/2019 | Nilsson |
| D843,149 | S | 3/2019 | Nilsson |
| 10,287,057 | B2 | 5/2019 | Nilsson |
| D869,195 | S | 12/2019 | Nilsson |
| D882,290 | S | 4/2020 | Nilsson |
| 10,674,817 | B1 | 6/2020 | Cao |
| 10,906,706 | B2 | 2/2021 | Nilsson |
| D973,476 | S | 12/2022 | Ryden |
| D984,257 | S | 4/2023 | Nilsson |
| 2003/0102315 | A1 | 6/2003 | Cheng |
| 2005/0077299 | A1 † | 4/2005 | Cheng |
| 2016/0052665 | A1 | 2/2016 | Tsai |
| 2016/0144999 | A1 † | 5/2016 | Tang |
| 2018/0339800 | A1 | 11/2018 | Cao |
| 2018/0352953 | A1 | 12/2018 | Nilsson |
| 2019/0110593 | A1 | 4/2019 | Nilsson et al. |
| 2019/0284815 | A1 | 9/2019 | Schlipper |
| 2020/0113329 | A1 | 4/2020 | Nilsson |
| 2020/0154887 | A1 | 5/2020 | Nilsson |
| 2020/0196757 | A1 | 6/2020 | Nilsson |
| 2020/0317403 | A1 | 10/2020 | Nilsson |
| 2020/0323340 | A1 | 10/2020 | Nilsson |
| 2021/0061683 | A1 | 3/2021 | Campbell |
| 2021/0133240 | A1 | 5/2021 | Talbot |
| 2021/0133241 | A1 | 5/2021 | Xu |
| 2021/0274933 | A1 | 9/2021 | Nilsson |
| 2021/0337966 | A1 | 11/2021 | Nilsson |
| 2021/0337967 | A1 | 11/2021 | Nilsson |
| 2021/0394954 | A1 | 12/2021 | Nilsson |
| 2022/0047071 | A1 | 2/2022 | Nilsson |
| 2022/0338627 | A1 | 10/2022 | Ringenhag |
| 2023/0023464 | A1 | 1/2023 | Nilsson |
| 2023/0026525 | A1 | 1/2023 | Nilsson |
| 2023/0192355 | A1 | 6/2023 | Nilsson |
| 2023/0276940 | A1 | 9/2023 | Nilsson |

FOREIGN PATENT DOCUMENTS

| | | | |
|---|---|---|---|
| DE | 202011051625 | U1 | 12/2011 |
| DE | 202018107059 | | 1/2019 |
| DE | 202018107059 | U | 1/2019 |
| DE | 202021101491 | | 4/2021 |
| DE | 202021101491 | U | 4/2021 |
| EP | 1424287 | A1 | 6/2004 |
| EP | 4201543 | | 6/2023 |
| ES | 2265203 | A1 | 2/2007 |
| FR | 1444104 | | 7/1966 |
| GB | 143962 | | 5/1920 |
| GB | 143962 | A | 5/1920 |
| SE | 2151577 | A1 | 6/2023 |
| WO | 2021262070 | | 12/2021 |

OTHER PUBLICATIONS

Swedish Search Report issued in SE App. No. 2151577-0, 1 page, Dated Sep. 16, 2022.

Written Opinion of the International Searching Authority, International Application No. PCT/SE2021/050609, Dated Sep. 19, 2021.

European Search Report issued in App. No. EP22214066, dated May 3, 2023, 4 pages.

Search Report received from Swedish Application No. 2151577-0, dated Sep. 16, 2022. 1 page.

† cited by third party

MESH CONTAINER AND METHOD FOR PRODUCING A MESH CONTAINER

This application claims priority to Swedish Patent Application No. 2050739-8, filed Jun. 22, 2020, which is incorporated herein in its entirely for all purposes.

FIELD OF INVENTION

The present disclosure relates to a method for producing containers in mesh material made by expanding perforated sheet metal. The disclosure also relates to mesh material containers.

BACKGROUND

Containers made from mesh materials to form a container are described for instance in EP-1424287-A1. The containers have a first and a second set of opposing side panels, a bottom panel, and a rim directed outwards from the upper edges of the side panels. A container is formed from three mesh pieces and a non-mesh rail is fitted to the upper edges of the container to form a rim or frame.

EP-1424287-A1 describes a method for producing a container for a drawer system. The container comprises an upper rail and a basket portion coupled thereto. The basket portion comprises panels of mesh material. In one illustrated example, the basket is formed by three separate mesh pieces, one typically forming the bottom and two opposing side walls, while the other two form the remaining two side walls in a rectangular basket. Seams are formed between the separate parts and a rail may be welded at the rim of the container.

SUMMARY

Disclosed are representative, non-limiting examples of a mesh container with outwardly extending rims that can be constructed more efficiently, and examples of a production method that can more efficiently construct meshed containers with outwardly extending rims, thus enabling lower manufacturing costs.

The examples contemplate a mesh container with four sides, a bottom, and a rim extending from a top edge of the four sides that surrounds an opening defined by the top edges of the four sides. However, the methods are not necessarily limited to this geometry and may be adapted to other geometries.

A non-limiting, representative example of a method for use in constructing a mesh container with four or more sides, a bottom, and a rim extending outwardly from the top of the sides, comprises expanding a perforated portion of a web of sheet metal by stretching it along an expansion direction to create a stretched or expanded portion of mesh and unstretched portion of sheet metal. A precursor for a mesh container is then cut from the web, the precursor comprising at least two side panels made at least partly from the mesh and an unstretched portion of sheet metal, from which to form a portion of the rim. The precursor is then folded as a single piece to form at least two side panels and rim for a mesh container with an overlapping joint between the two side panels and the rim integrally formed with the side panels.

A non-limiting, representative example of a mesh container comprises a first and a second set of opposing side panels, a bottom panel and a rim directed outwards from the upper edges of the side panels, wherein at least one side panel from each of the first set of opposing side panels, a portion of the rim that connects them, and a portion of the bottom panel are comprised of a single piece cut from web of sheet metal containing a mesh portion and a unstretched metal portions.

Such a method and mesh container allow for the use of a single piece of web to be used to form at least the sides and rim without requiring a separate step of attaching a rim, which can result for improved production efficiency.

In a further embodiment of the exemplary method, a perforated intermediate portion of a web of sheet metal is expanded along an expansion direction to create a web with an intermediate stretched portion of mesh between a leading unstretched portion and a trailing unstretched portion. The resulting web is cut through the intermediate mesh portion to form a first precursor and a second precursor. Each of the first and second precursors comprises a single piece from the web of sheet metal and contains mesh from the intermediate stretched portion of the web and one of the unstretched portions. The unstretched portion of the first precursor comprises the leading unstretched portion of the web, and the unstretched portion of the second precursor comprises the trailing unstretched portion of the web. Each precursor is then folded to form at least a first and a second side and at least part of a rim of the mesh container.

Further embodiments of the method and a mesh container may be formed from two precursors (from the same web or different webs), with each precursor folded to form two of the four side panels of the mesh container and one of two portions of the rim from two precursors. This embodiment permits the web of sheet metal to have a smaller width for a given container size.

In yet another embodiment, each of the first and second precursors is comprised at least four side panels, each of the first and second precursors being used to form first and second mesh containers.

A precursor used in any one of the foregoing and other embodiments may include one or more portions for making up the bottom panel for the mesh container. The bottom panel portions can be, for example, an extension of a side panel, allowing the bottom panel portion to be made by folding the bottom panel portion along a boundary with the side panel. Thus, no joint is formed between the bottom panel and this side panel. The unitary construction of the side and adjacent portion of the bottom of the mesh container result in stronger mesh container. Instead of having a joint between the sides and bottom, two or more bottom panel portions are joined by at least one by an overlap located on the bottom of the mesh container. Optionally, in the embodiments from which two precursors are cut from a single web, the side panels and a bottom panel of each of the first and second precursors cab be laid out on the web of sheet metal to reduce waste of sheet metal when cutting the precursors from the web of sheet metal.

The side panels for any of the foregoing embodiments of methods and mesh containers may have, optionally, a lower part comprised of mesh and an upper part comprise part of the unstretched portion of the web of sheet metal used to form the rim of the mesh container. This makes the upper part of the container with the rim stronger.

Optionally, in any one of the embodiments described herein or in other methods using and apparatus formed from a web of sheet metal containing a mesh portion formed by perforating and expanding the sheet metal next to an unstretched portion, one or more rows of openings of the mesh portion nearest the boundary with an unstretched portion may be formed with reduced sized opening as compared to other rows in the mesh portion. This helps to reduce the risk of unintentionally deforming the web at the transition between areas of mesh and unstretched areas.

In each of the foregoing embodiments of the methods and mesh containers, the bottom panel may, optionally, be embossed in a pattern to make it more rigid or stable.

In embodiments with in which first and second bottom panel portions overlap to form a joint, the bottom panel may be embossed along the overlap to make the connection between the bottom panel portions stronger. For example, the cross-section the embossment may be half circle arching between the two bottom panel portions. Embossing the joint makes the joint stronger and the bottom panel as a whole stiffer. Furthermore, locating edges of the two panel portions within the embossment, which can reduce the risk of snagging or tangling clothing.

The foregoing is intended only as a non-limiting summary of representative, non-limiting examples and embodiments of mesh containers and methods for use in constructing that are disclosed below. Additional examples and embodiments will be described below or apparent to those in the art.

DETAILED DESCRIPTION OF EXEMPLARY EMBODIMENTS

In the following description, like numbers refer to like elements.

Figure 1:
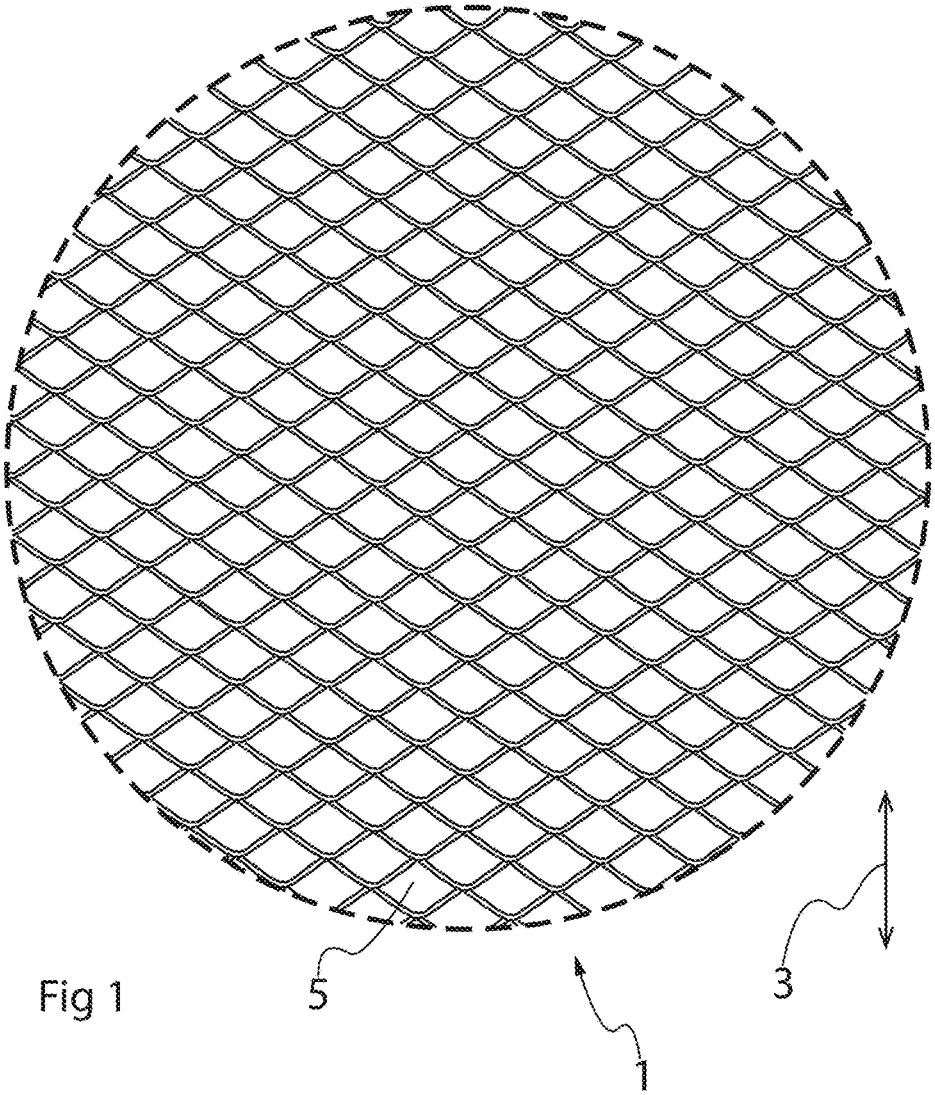
FIG. 1 shows a mesh material.

The present disclosure relates generally to methods for producing containers in mesh materials and to containers made from mesh materials. A mesh material, an example of which is a sheet of mesh material 1 shown in FIG. 1, is material resulting from a sheet of metal provided with openings that is expanded to widen those openings. For example, to form the sheet of mesh material 1, a sheet of metal may be pierced with short, line-shaped openings and stretched along a stretch direction 3 to form, for example diamond-shaped openings 5, in the sheet of metal.

In the present disclosure a more efficient method of producing a mesh container is described. This is accomplished for instance with less waste of material, fewer parts and fewer production steps, each providing an advantage over prior art methods.

In the present disclosure, rather than separately forming pieces making up different panels of a container by cutting up a perforated, stretched web of sheet metal, welding those pieces together and attaching a separate rail at the rim of the container, the container is formed almost as a whole already from a single web of sheet metal by preparing one or more mesh metal precursors.

Generally, thus, a web of sheet metal is perforated and expanded along an expansion direction, while leaving a portion of the sheet metal web unstretched. At least one precursor is cut from the web, and a container is folded, including said at least one precursor, wherein the precursor makes up, in one piece, at least a side panel in the first set of side panels and a side panel in the second set of side panels, which are joined by a rim portion comprising said unstretched portion of the web. Thereby, a very effective manufacturing of a container is provided, where no special parts need be added to form the rim of the container.

Figure 2:
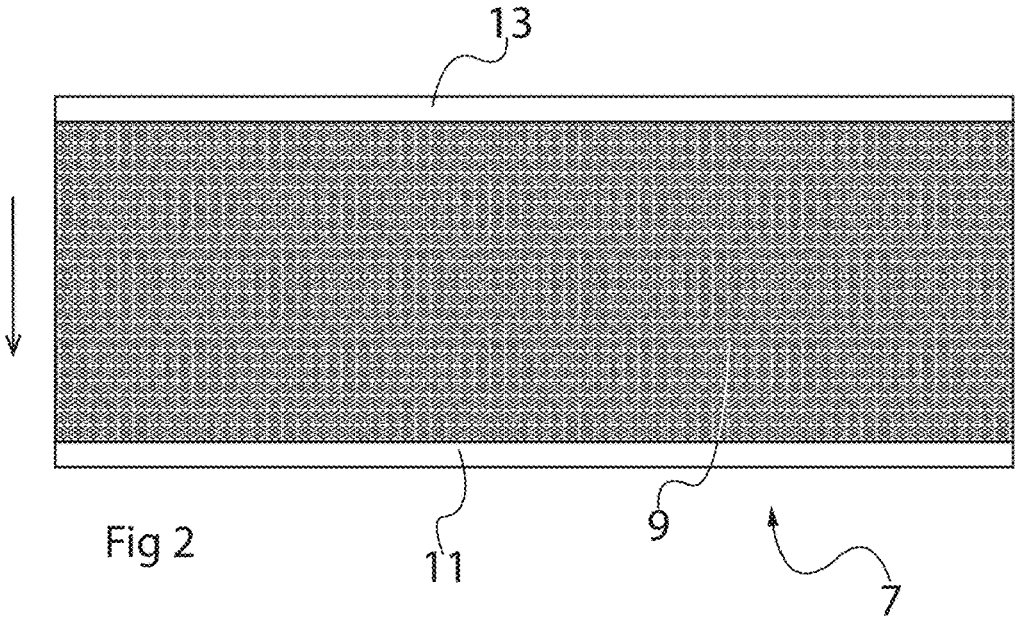
FIG. 2 illustrates a partly stretched web of sheet metal.

FIG. 2 schematically illustrates a partly stretched web 7 of sheet metal. This web may be formed from the entire width of a roll of sheet metal, typically steel. The web may typically be a few meters wide, for example about 1900 mm. The web may be produced from the roll in the direction illustrated by the arrow of FIG. 2, and may be perforated and expanded by a processing machine along an expansion direction which may coincides with the indicated direction The processing machine may simultaneously cut and expand the material with sets of knives that first provide a cut transversely to the feed direction of the roll and then widens this cut into an almost rhomboid shape by driving the knife, having a widening cross section, further through the cut. The web 7 of sheet metal is thus cut across and expanded along an expansion direction 3. However, a leading portion 11 and a trailing portion 13 of the web 7 is left uncut and unstretched with an intervening cut and stretched portion 9. After the trailing portion 13 the web 7 is separated from the remainder of the roll.

Figure 3A:
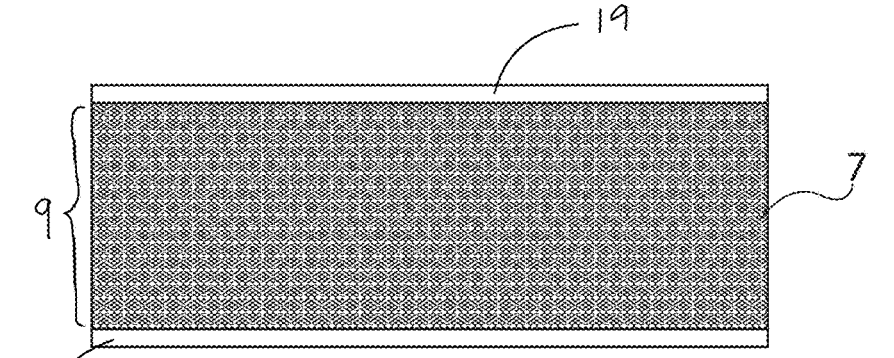
FIGS. 3*a*-3*c* illustrate how a web of sheet metal perforated and stretched as shown in FIG. 2 is cut to form two precursors for making mesh containers.
Figure 3B:
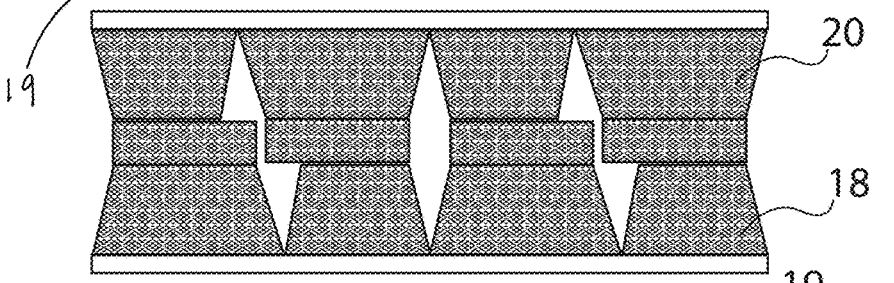
Figure 3C:
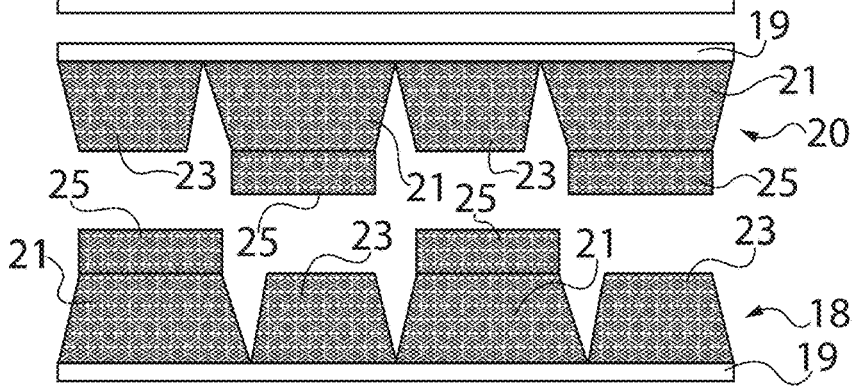

The web 7 formed as illustrated in FIG. 2 is then cut to form two precursors 18, 20 for making the mesh containers as shown in FIGS. 3*a*-3*c*. This is done by cutting the web 7 across the stretched portion 9. Further, some parts of the stretched portion 9 are removed to form the shapes illustrated in FIG. 3*b*. As shown in FIG. 3*c*, a leading web part (bottom) and a trailing web part (top) each form, respectively, a precursor 18, 20 for mesh container.

Each web part or precursor in this example includes side panels 21, 23 and bottom panel portions 25 from which to form the sides and bottom of a mesh container, and an unstretched portion 19 from which to form the rim of the mesh container. In the illustrated case, the container will have panels forming long and short side walls, although a square layout with side walls of equal width is also possible.

A complete or almost complete container can now be formed from the first precursor 18. The leading unstretched portion will be used to form the rim of the first container. Adjacent parts for the side panels 21, 23 will be joined using a small overlap. Parts making up the bottom panels portions 25 will also be joined using a small overlap and also joined laterally with small overlaps with the bottom edges of the panels 23, from which they do not extend. Although welding and soldering are the most common methods of joining to overlapping portions of two parts made of mesh, parts with overlaps may be joined by any suitable method. Examples of suitable methods might include by way of example welding, soldering, gluing, clamping, fastening with mechanical fasteners, or other means for mechanically connecting the overlapping portions.

A second container may be folded in the same way from the second precursor 20 wherein the trailing unstretched portion 19 will be used to form the rim of the second container.

As can be seen for example in FIG. 3*c*, parts in the web making up the first set of side panels 21 and the bottom panel portion 25 of the first precursor 18 are aligned with parts making up the second set of side panels 23 of the second container 20, and vice versa. Alternating deeper parts for side panel 21 and a bottom panel portion 25 of one precursor with comparatively shallow parts of the other precursor, consisting in this example of the parts for side panels 23, results in less of the expanding web portion 7 meeting to be cut away, as best seen in FIG. 3*b*. This results in less material waste that would need to be recycled. A layout with a part for the side panel 21 and a portion of the bottom panel 25 also reduces waste and makes the finished container stronger as compared to, for example, a precursor with a single part for making up an entire bottom panel.

Figure 4:
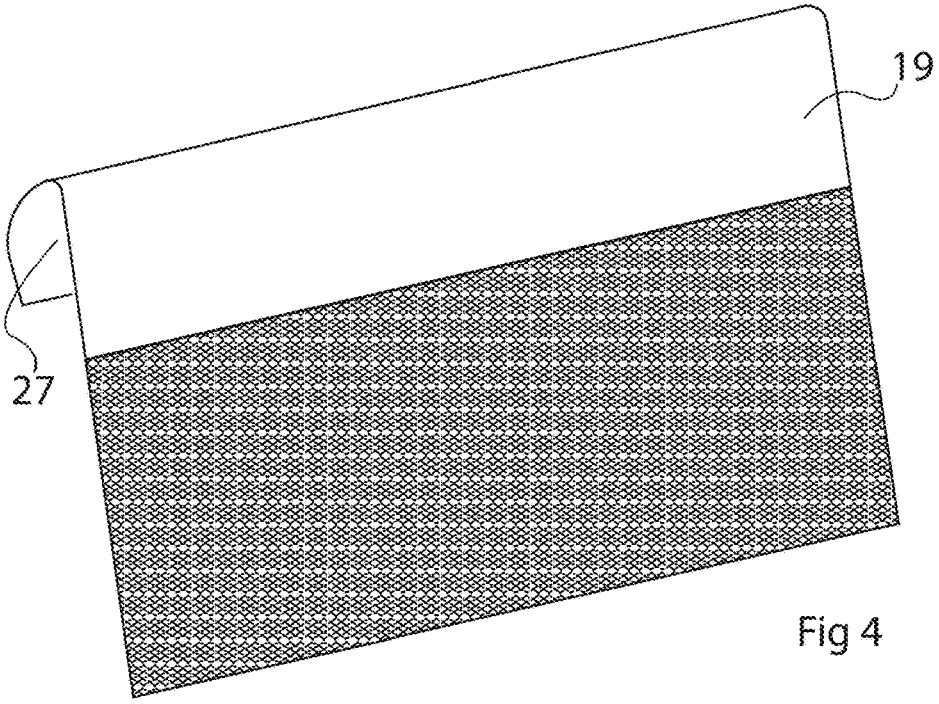
FIG. 4 illustrates forming a rim of a container.

FIG. 4 illustrates forming a rim 27 or frame of a container. The unstretched portion 19 (cf. FIG. 3*c*) of the web that adjoins the parts comprising the side panels 21, 23 is used to form the rim of the container by folding the unstretched portion 19 outwards from the inner of the container. Forming the rim as a single layer flange is one option. However, if the sheet metal is relatively thin, for example 0.7 mm, another option is to form at least a portion of the rim surrounding the perimeter of the opening in the mesh container using a different construction. This will also tend to strengthen the container as a whole.

One to increase the strength or stiffness of portion of the rim is to fold part of the outwardly extending unstretched portion 19 downwards towards the bottom of the container. Such a bend will tend to stiffen the rim. Further the outer edge of the unstretched portion 19 may be folded or rolled inwards towards the outer face of the associated side panel as shown in FIG. 4. This may form a double layer or, optionally, a hollow channel that provides additional structural rigidity to the rim portion. Further, as the edge of the unstretched portion may in principle comprise burrs etc, bending the edge inwards gives the outer periphery of the rim becomes more pleasant to hold when carrying the container.

As also illustrated in FIG. 4, it is possible to use part of the unstretched portion 19 to make up also a top part of each of the side panels. This means that the outwards projecting rim portion is folded at a point a few centimetres from the boundary of the mesh portion, which will form most of the side walls, and the unstretched portion 19. Incorporating into or making a top part of a side wall from of unstretched metal will tend to strengthen and to stiffen the transition between the side wall and rim, making the rim stronger.

Figure 5:
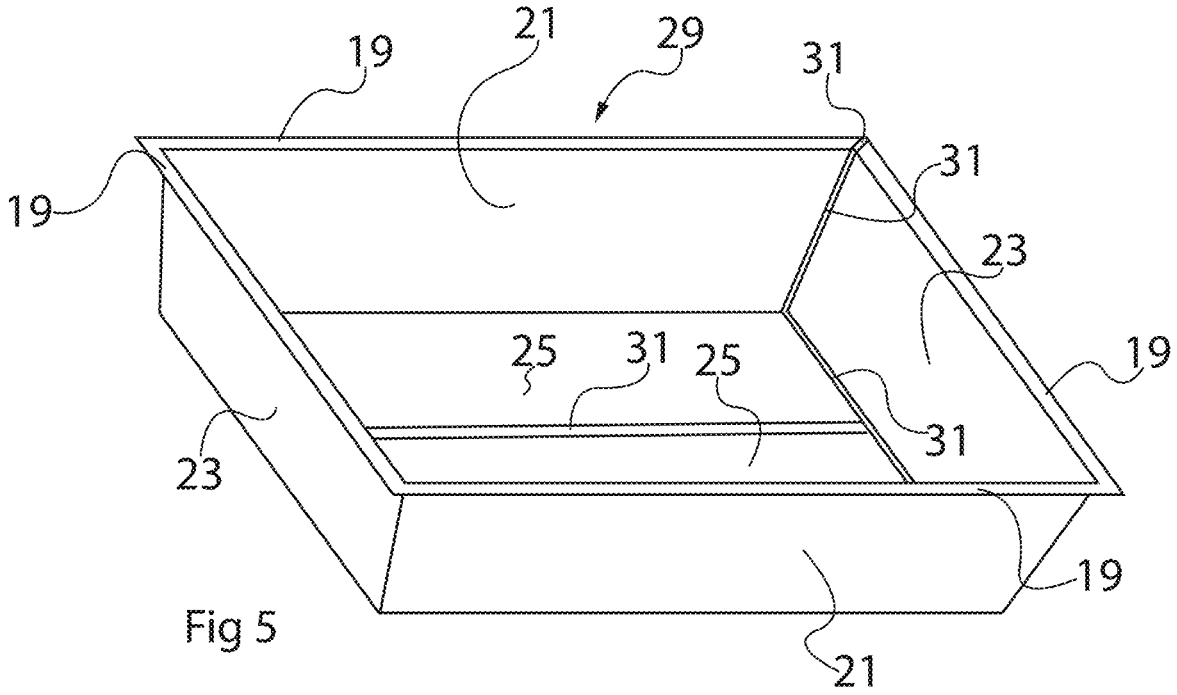
FIG. 5 illustrates a container formed from a precursor as shown in FIG. 3*c*.

FIG. 5 illustrates a container 29 formed from a precursor as shown in FIG. 3*c*. This container can be made in one piece, comprising joints 31, formed by overlaps, only at the middle of the bottom panel 25, between the side panels 21, 23 and between the joint bottom panel 25 and the short-side side panels 23. The rim portion also needs a joint 31, but only at one location. The reduced amount and placement of joints improves the strength of the overall construction of the mesh container, allowing it to be made of thinner material and in one piece.

Figure 6:
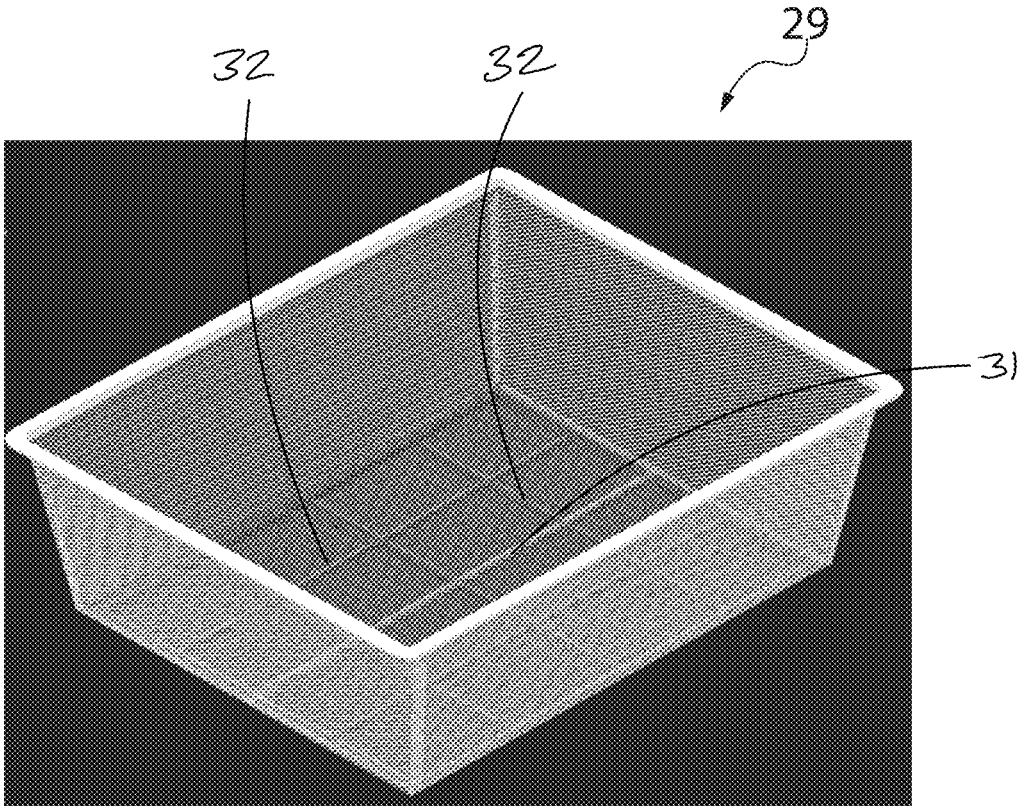
FIG. 6 is a picture of such container with an embossed bottom panel.

As shown in the picture of FIG. 6, the bottom of a mesh container made according to any one of the examples disclosed herein may be embossed with a pattern. The bottom 32 of mesh container 29 is, in the illustrated example, embossed with a square pattern of protruding ridges 32. This improves the stability of the bottom of the mesh container, making the bottom less prone to bulging in a direction perpendicular to its plane. It will be, therefore, perceived as less flimsy. An embossed ridge along the overlap between the two bottom panel portions 25 may also, or instead, make the connection or joint overlap between those portions stronger.

Figure 7A:
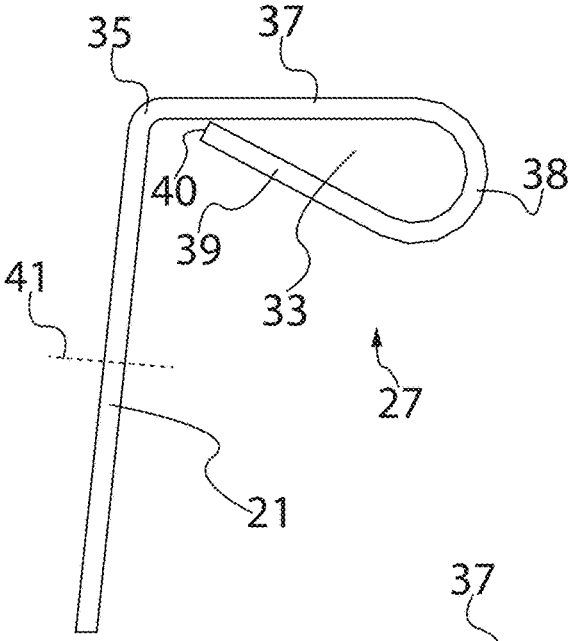
FIGS. 7*a* and 7*b* show cross sections through alternative examples of a finished rim portion.
Figure 7B:
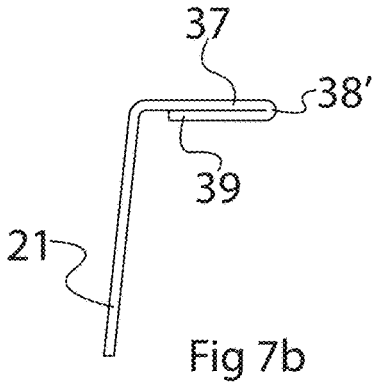
Figure 20:
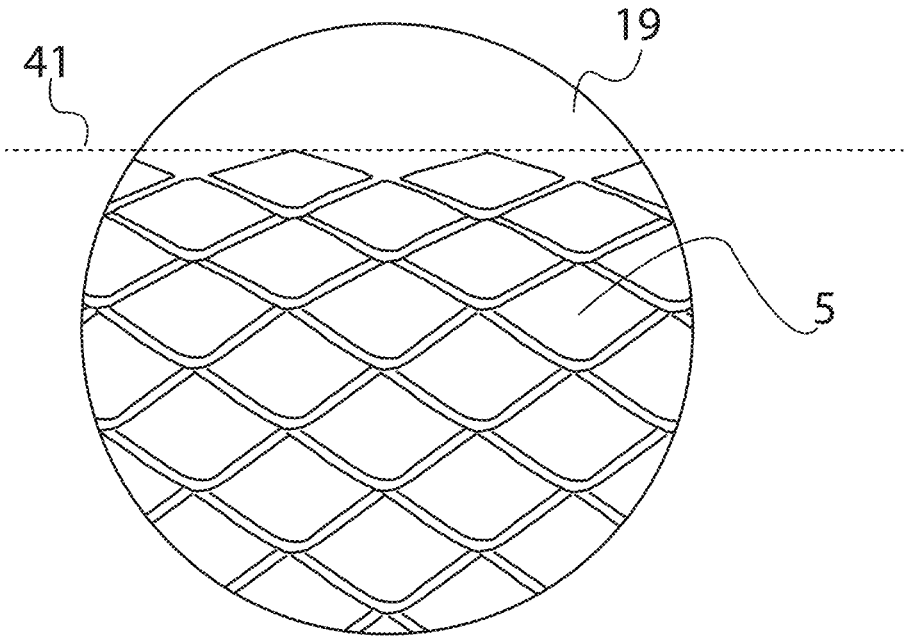
FIG. 20 illustrates a transition between a meshed and an unmeshed area.

While FIG. 4 illustrated the rim portion during forming thereof, FIG. 7*a* shows a cross section through a finished rim 27. As each portion of the rim 27 is in one piece with the side panel 21, there is no need for a specific operation attaching the rim portion 27 to the remainder of the container. The rim portion 27 could be shaped before folding and joining the panels for the container, but it may be preferred to form the rim portion 27 as a subsequent step instead. In any case, the rim portion 27 is made by bending unstretched portion outwards, out of the plane of the side panel 21, at a bend 35, typically a little less than 90 degrees. The outward extending portion is then bent downwards and inwards, forming in cross section a first 37, top and outwards extending, leg and a second 39, bottom and inwards extending, leg joined by an outer bend 38. While this outer bend 38' could be sharp, forming a flat double layer from the first and second legs 37, 39 as indicated in FIG. 7*b*, it is preferred to form the outer bend 38 with a radius. The second leg 39 may then be bent almost until its edge 40 touches the first leg 37. This provides the aforementioned channel 33 with a drop-shaped cross section and has several advantages. The rim portion 27 thereby becomes stiffer, and the edge 40 of the second leg 39 becomes hidden to some extent which limits the need for removing burrs, etc. on the edge 40. As already indicated the unstretched portion may reach down on the side panel to a transition line 41 to provide additional stability to the rim portion 27. Thus, above this line, the panel is unstretched 19, but below it is perforated. Preferably, the first few rows of openings 5 in the mesh, closest to the transition line 41 have a reduced size, increasing gradually for example three rows from the transition line 41. This reduces the risk of the sheet metal being deformed by the transition from non-mesh to mesh. An example is illustrated in FIG. 20. In order to achieve the reduced openings, the tool cutting and expanding the sheet metal makes shallower strikes when forming the first few rows of openings.

Figure 8:
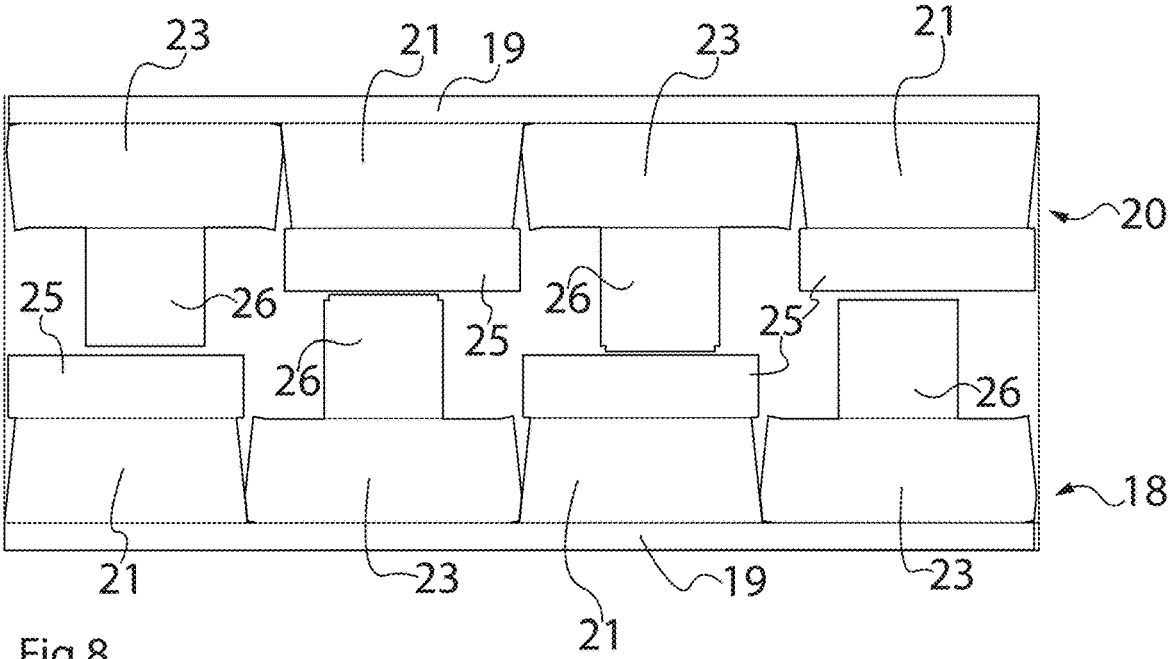
FIG. 8 shows an alternative layout for forming two mesh containers in a quadratic format.
Figure 9:
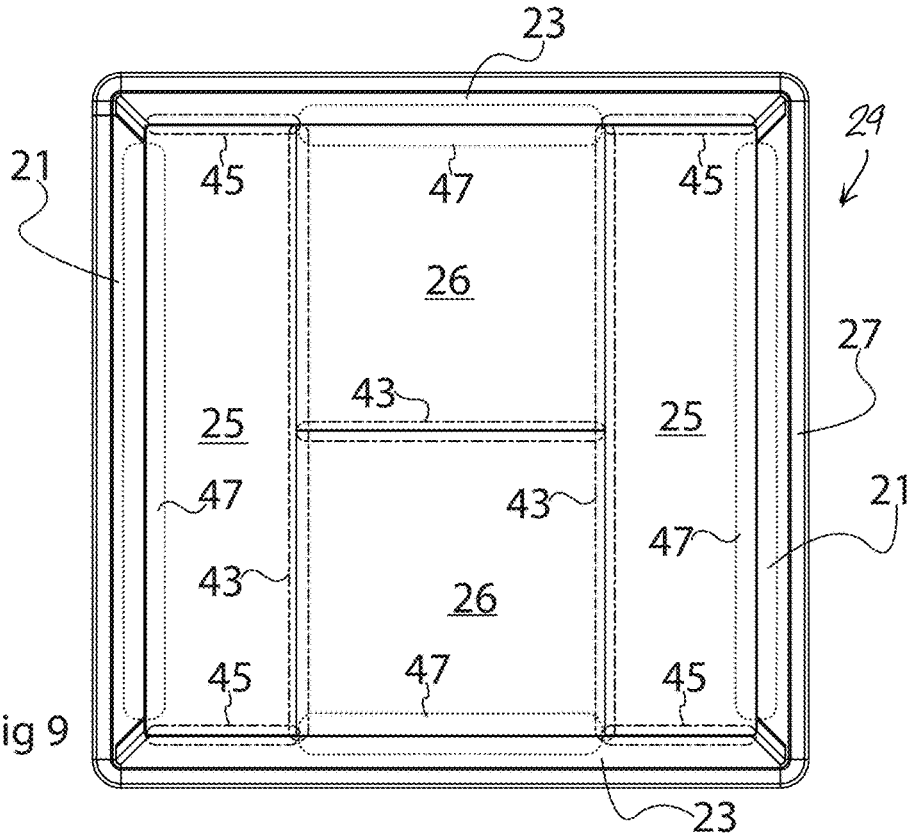
FIG. 9 is a top view of a quadratic mesh container prior to embossing its bottom panel.

Referring to FIGS. 8 and 9, which are schematic illustrations of an alternative layout for forming two mesh containers 29 in a rectangular format. In a fashion like that of FIGS. 3*a*-3*c*, first and second precursors 18, 20 are formed from leading and trailing portions of a sheet metal web where an unstretched portion 19 is kept at the leading edge of the first precursor and in the trailing edge of the second precursor, respectively. In this example, each side panel 21, 23, is formed in one piece with a bottom panel portion 25, 26, respectively, that will form part of the bottom of the mesh container. A comparatively short and wide bottom panel portion 25 extends from each side panel 21 in an opposing pair of panels. A relatively longer and narrower bottom panel portion 26 extends from the panels 23 in the other pair.

As shown in FIG. 9, when a precursor 18, 20 is folded into a container, the bottom panel portions are folded to establish a bottom. The joints or seams between the bottom panel portions 25, 26 form an "H" shaped configuration. The joints are formed by overlaps. The areas of overlap are generally indicated by dashed lines 43. However, the overlaps are not explicitly shown in the figure. The ends of the longer and narrower bottom panel portions 26 meet and overlap along a seam in the middle of the bottom of the container. The shorter and wider bottom panel portions 25 fill in the lateral areas to each side of the longer and narrower bottom panel portions 26 and overlap the longer and narrower bottom panel portions 26. The overlaps are then welded, soldered, glued, or otherwise connected to form joints to hold the bottom panel portions together to form the bottom of the mesh container.

In addition, overlaps exist between the side panels 23 and overlaps between the lateral sides of the shorter and wider bottom panel portions 25 and the corresponding side panels 23, which are circled using dashed line 45. With this configuration, the total length of overlaps and corresponding welds at the transition between side panels and bottom panel portions are reduced. Along the bottom panel periphery where it meets the side panels, overlaps 45 are only needed at four relatively shorter sections, which are located close to the corner where the strength requirements are not as high. With this configuration, at least a portion of the bottom edge of each of the side panels 21, 23 is not connected to a bottom panel portion 25, 26 through an overlapping joint. Rather, the transition in the areas indicated by dashed lines 47, between a side panel 21, 23 and a connected bottom panel portion 25, 26 are created by a folder, are formed by a fold, not an overlapping joint. They are integrally formed with the bottom panel directly through a fold. Further, the total length of the joints between side panels 21, 23 and bottom panel portions can be reduced, with a greater percentage of intersection of the side panels and bottom panels constituting a fold and not an overlapping joint. Thus, because each of the side panels is made from a single piece, there is less risk for joint breaking.

Figure 10:
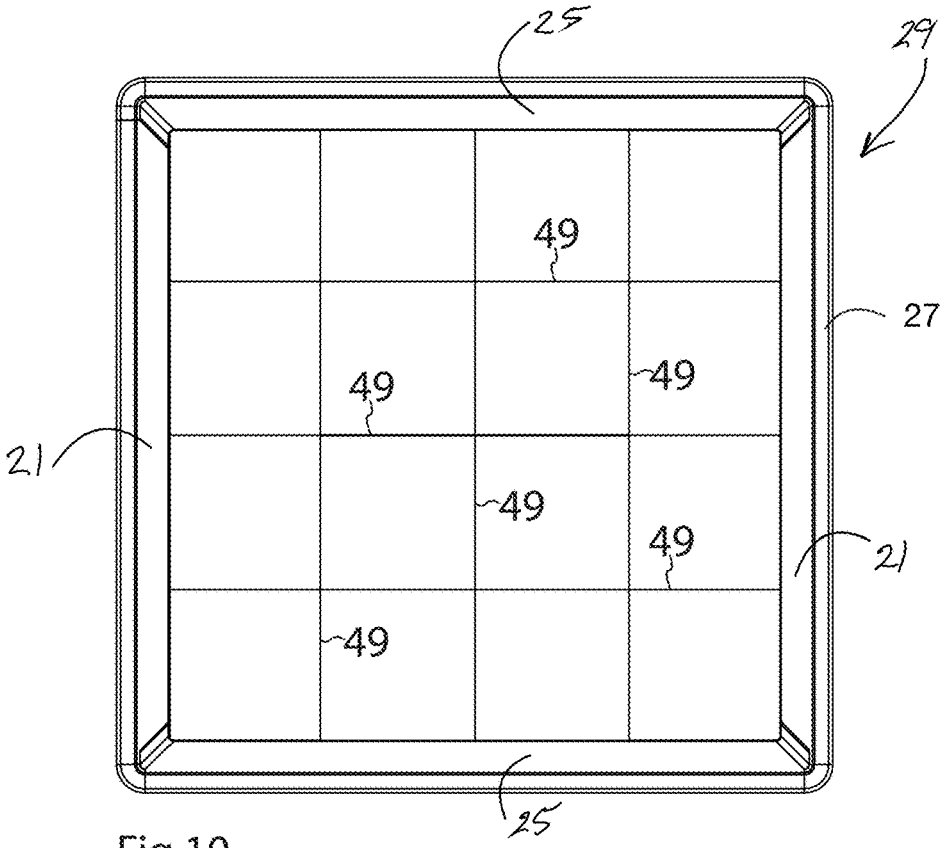
FIG. 10 shows the top view of FIG. 9 after embossing of the bottom panel.
Figure 11:
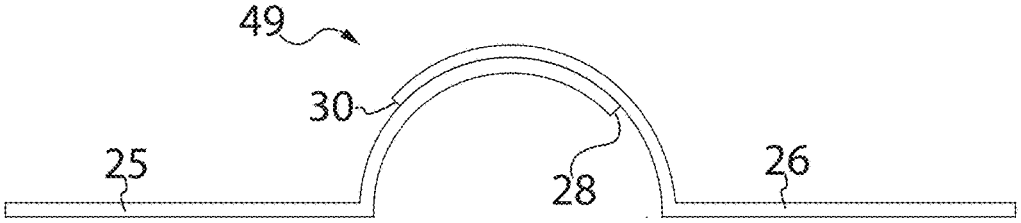
FIG. 11 schematically illustrates an overlap between two bottom panel portions at an embossing.

Turning to FIGS. 10 and 11, overlapping areas in the bottom panel portions of a mesh container, including any of them disclosed herein, may optionally be embossed to provide increased strength, keep burrs and the like away, eliminate the bottom panel bulging, and provide an aesthetically interesting appearance.

FIG. 10 shows a top view of a representative example of a mesh container after embossing of the bottom panel. In this example, a rectangular pattern of ridges 49 are embossed on the bottom of the mesh container 29 shown in FIG. 9. Note that the embossing pattern is aligned with the joints between the bottom panel portions, thus the bottom panel portions are not directly indicated in figure. This pattern may give the impression of a legacy-type wire basket. However, other patterns could be used.

The pattern may also make the bottom panel stiffer and less likely to bulge. FIG. 11 is a cross section through an overlap of two bottom panel portions 25, 26, along that has been embossed with ridge 49. As previously discussed, a joint may be formed by providing an overlap of the two panel portions and welding or soldering, for example, the overlap to join the portions at the overlap. The cross-sectional shape of the ridge 49 is in the illustrated example of a half-circle shape arching between the two panel portions 25, 26. This embossing 49 makes the joint between the panel portions 25, 26 stronger, and further the bottom panel as a whole becomes less flimsy, as the panel is less prone to bend about an axis which is parallel with the cross section of FIG. 11 and the bottom panel as a whole.

Furthermore, even if it does not increase the strength of the bottom panel, embossing the overlap between panels can allow for folding the edge of the panel portions in manner that reduces the risk of the edge catching or entangling fabrics and the like due to, for example, burrs along the edges. In the example, the edges 28, 30 of the two panel portions 25, 26 are located within the arching shape formed by the embossing to provide this effect.

The ridges 49 can be made to protrude upwardly or downwardly (or both) from the bottom panel main plane and need not have cross-section that is a half-circle. Other cross-sectional shapes are conceivable, such triangular, square, and elliptical, as well as more complex ones. Furthermore, displaced surface features other than ridges could be used to form the pattern.

Figure 12A:
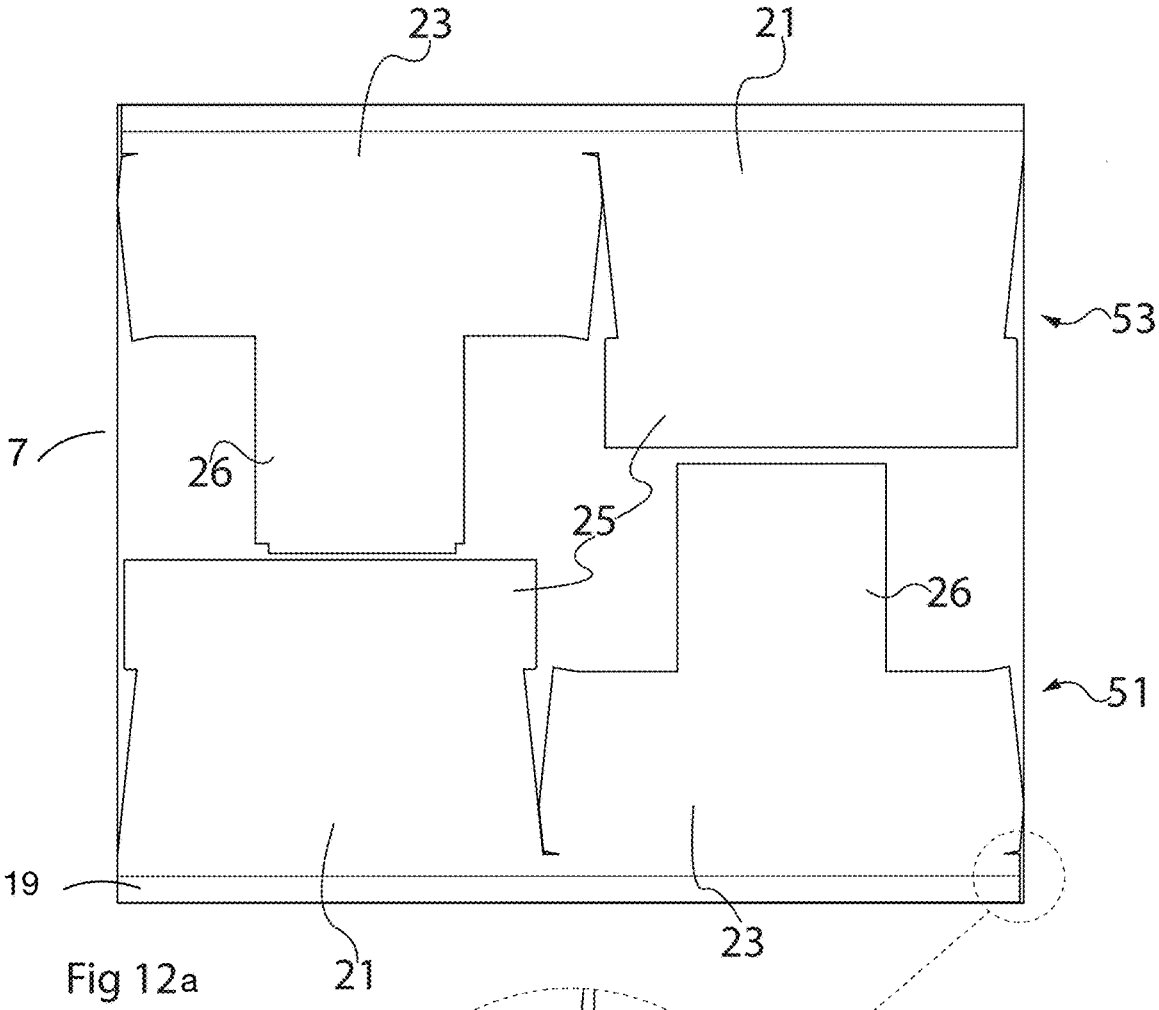
FIG. 12*a* shows an alternative layout for forming a single mesh container in a quadratic format from a mesh web.

FIG. 12*a* shows an alternative layout for precursors to form a single mesh container in a rectangular format from a mesh web. This alternative layout may be advantageous when making large containers, where a precursor having all side panels connected to a single unstretched area would otherwise require a machine capable of perforating and expanding processing a very wide web. In the arrangement in FIG. 12*a* the whole width of the web is used for one panel each in a first and a second pair of opposing panels. The leading precursor 51 thus forms two side panels 21, 23 and the trailing precursor 53 the two other side panels 21, 23. This allows the container to be produced in a less expensive production line at the cost of adding another joint in the unstretched portion 19 forming the rim. The finish mesh container will have a rim with two joints instead of one. The precursors 51, 53 may be used to form a mesh container in a manner similar to the one described in connection with FIGS. 9 and 10.

The layout of FIG. 12*a*, where the web makes up one single container has another advantage. When folding a container from the precursors 51, 53 in FIG. 12*a*, the bottom panel portions 25 that will be joined in the bottom panel are stretched in the same way at the location where they are joined. That layout in contrast to the one shown in FIG. 8 requires that one bottom portion 25 is turned 180 degrees in relation to the other from the orientation in which the web was stretched before the bottom portions 25 can be joined. With reference to FIG. 1, that mesh structure will have a general visual appearance that is very much different depending on the viewing angle. Therefore, turning the bottom portion, as required with the embodiment of FIG. 8, may make one half of the bottom portion look lighter than the other, while the embodiment in FIG. 12*a* may give a visually more or less seamless transition from one bottom portion 25 to the other.

Figure 12B:
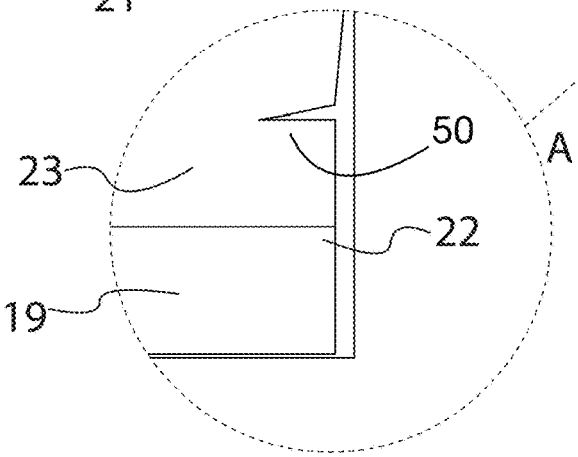
FIG. 12*b* is a detail of FIG. 12*a*.

Referring to FIG. 12*b*, which is an enlarged portion A of FIG. 12*a*, a tab 22 that is cut to project in the long direction of the unstretched area facilitates making the joint of a rim portion. With tab 22, the joint of the rim portion need not be located directly at a corner of the container, where it would be more exposed. Instead, the joint can extend into a rim portion side, providing for a stronger joint. A cut 50 can be made such that the tab 22 projects about 25 mm from the remainder of the rest of the precursor, or typically in a range between 15 and 40 mm.

Figure 13:
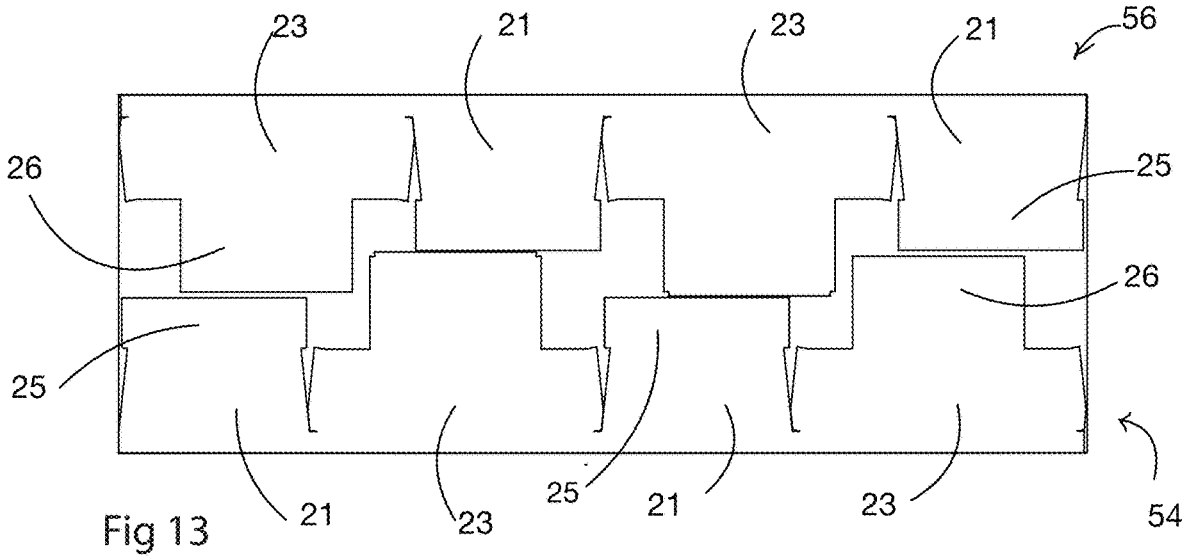
FIG. 13 shows an alternative layout for forming two mesh containers in a rectangular format from a mesh web.
Figure 14:
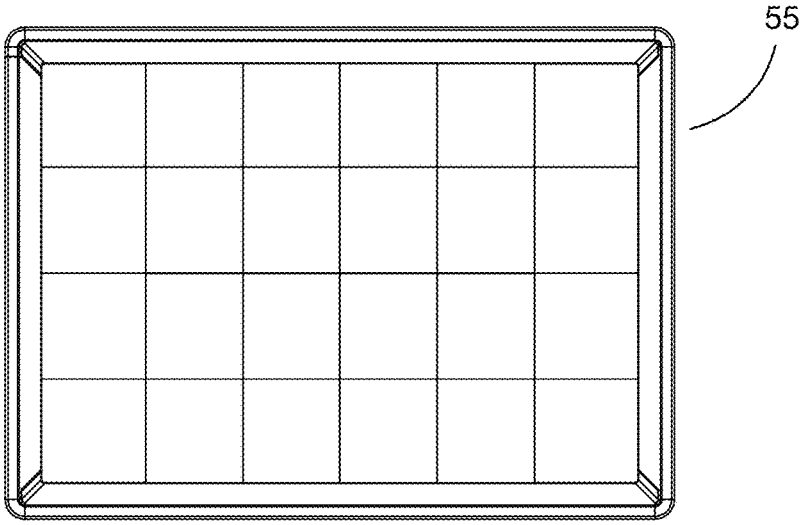
FIG. 14 is a top view of one of the rectangular mesh containers formed from the web in FIG. 13.

Turning to FIG. 13, the layout where each side panel in a precursor adjoins with a part of the bottom panel is not restricted to the quadratic format shown in FIGS. 8-10. FIG. 13 shows a layout for forming two mesh containers in a rectangular format from a mesh web 48 with two precursors 54, 56 in a way similar to forming the mesh containers from the layout of FIG. 8. FIG. 14 is a top view of a constructed rectangular mesh 55 container formed from the web in FIG. 13. This layout as well could have the half width, where the leading precursor forms one part of a container and the trailing precursor another, similar to the layout shown in FIG. 12*a*.

Figure 15A:
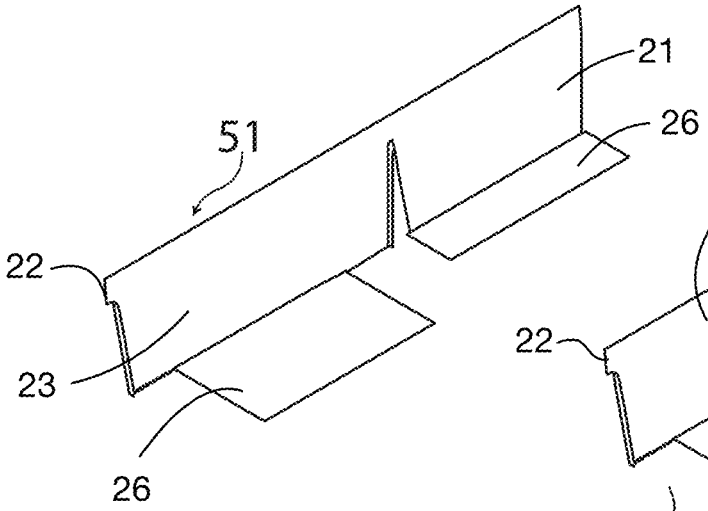
FIGS. 15*a* and 15*b* illustrate partially folded precursors for a first example of assembling of a container.
Figure 15B:
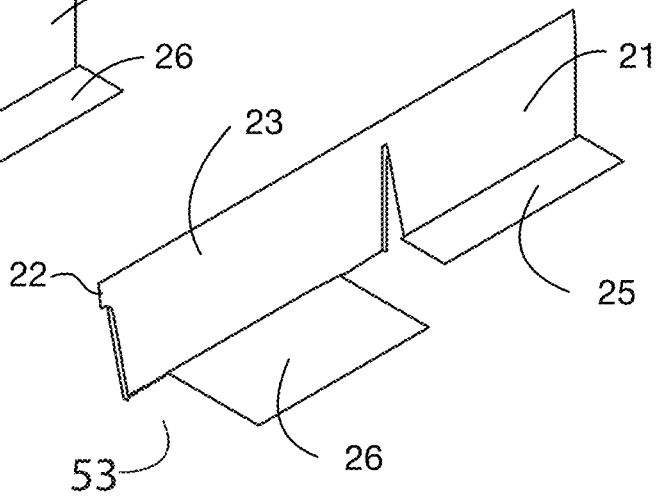
Figure 16:
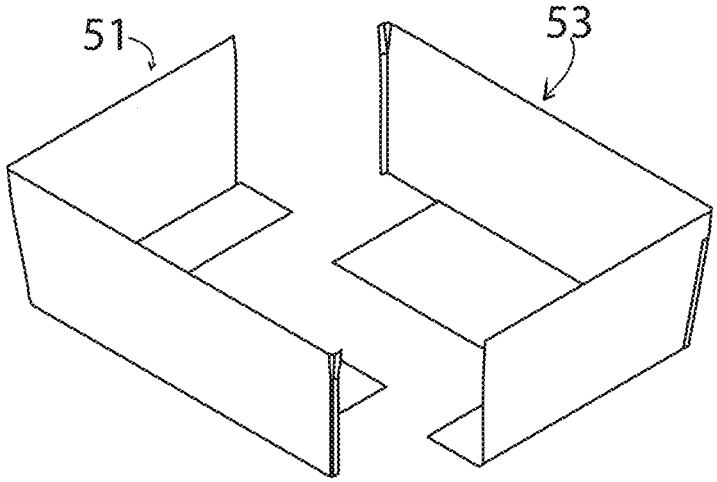
FIG. 16 illustrates further folding of the precursors shown in FIGS. 15*a* and 15*b*.

FIGS. 15*a* and 15*b* and FIG. 16 illustrate a first example of assembling of a mesh container 57, which in this example is rectangular, where two side panels are formed by a leading precursor 51 from the web and two side panels from a trailing precursor 53 from the web, similar to the precursors shown in FIG. 12*a*. Each precursor 51, 53 is folded, as illustrated in FIGS. 15*a* and 15*b*, and folding out the parts forming the bottom panels from the side panels. The adjoining side panels are then folded to form a corner therebetween, as seen in FIG. 16. Wide tabs may be provided to facilitate this. Then, the two such precursors 51, 53 are assembled and welded together to form the finished container. As can be seen in FIG. 16, the rim portion is not formed prior to this stage. The rim is formed by rolling the unstretched edge of the assembled container.

Figure 17:
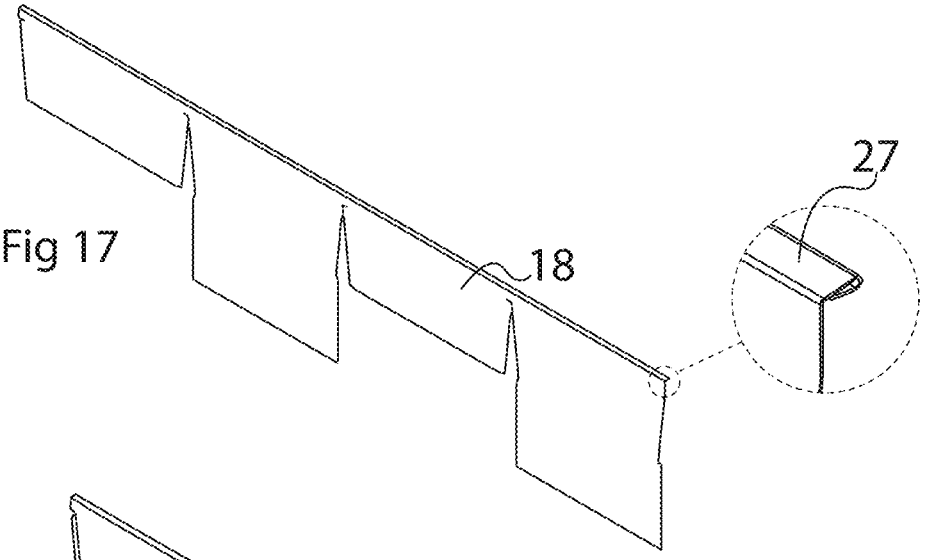
FIG. 17 illustrates a first step of a second example of assembling of a container.
Figure 18:
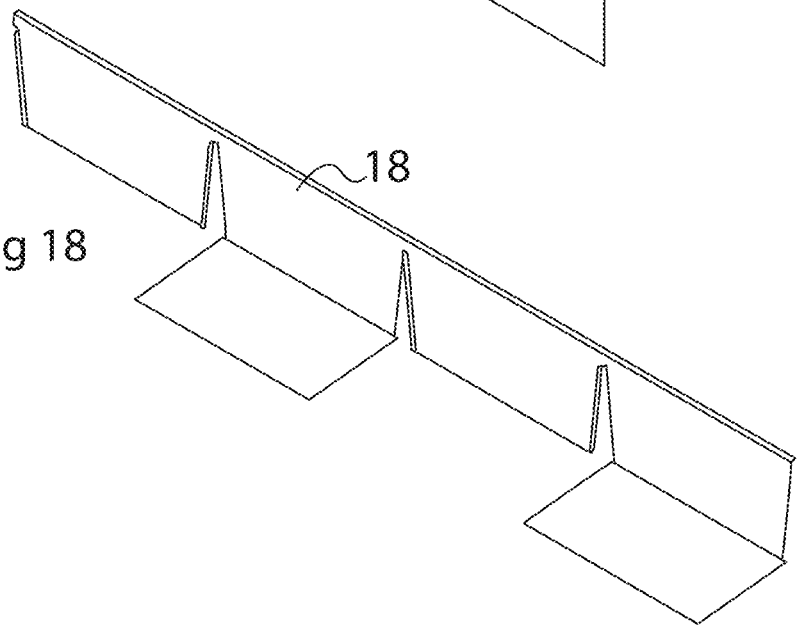
FIG. 18 illustrates a second step of the second example of assembling of a container.
Figure 19:
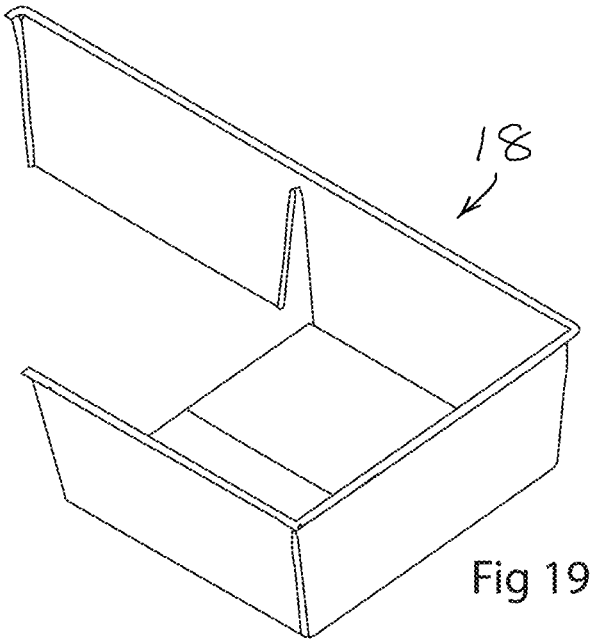
FIG. 19 illustrates a third step of the second example of assembling of a container.

FIGS. 17-19 illustrate an alternative, second example of assembling of a container. This example uses as a precursor the precursor 18 shown in FIG. 3*c*, which is formed from the entire width of the web is enough to form all panels of the container. In this case a rim 27 is formed as a first step, before folding the panels and assembling the container. Either forming the rim 27 before or after assembling the side and bottom panels into a mesh container is possible for all variations of precursors.

The present disclosure is not limited to the above examples and may be varied and altered in different ways within the scope of the appended claims.

The foregoing description is of exemplary and preferred embodiments. The invention, as defined by the appended claims, is not limited to the described embodiments. The embodiments are, unless otherwise noted, non-limiting examples of one or more inventive features. Alterations and modifications to the disclosed embodiments may be made without departing from the invention. The meaning of the terms used in this specification are, unless stated otherwise, intended to have their ordinary and customary meaning to those in the art and are not intended to be limited to specific implementations that may be described.

What is claimed is:

1. A method for use in making a metal mesh container that comprises four side panels made at least partly of metal mesh, a bottom panel made of metal mesh, and a surrounding metal rim extending outwardly from top edges of the side panels and made of solid metal; the method comprising:

cutting first and second precursors from a web of sheet metal comprising one or more portions that have been perforated and expanded along an expansion direction to form metal mesh, and one or more unstretched sheet metal portions, each of the first and second precursors having at least one solid metal portion from the one or more one or more unstretched portions of the web of sheet metal and at least one metal mesh portion from the one or more portions of web of sheet metal that have been perforated and expanded; and for each of the first and second precursors, folding the precursor to make up in a single piece first and second adjacent side panels for the metal mesh container, part of the bottom panel, and a portion of the surrounding metal rim extending outwardly from top edges of the first and second side panels, wherein the first and second side panels are at least partly made of metal mesh from the one or more metal mesh portions, and the portion of the surrounding metal rim joins the first and the second side panels and is formed from the at least one solid metal portion; and assembling the folded first and second precursors to form the four side panels of the mesh container from the first and second adjacent side panels from the first and second folded precursors and the bottom panel from the part of the bottom panel of from the first and second folded precursors.

2. The method according to claim 1, wherein:

the one or more unstretched sheet metal portions of the web of sheet metal comprise an unstretched leading portion and an unstretched trailing portion of the web of sheet metal, with an intermediate portion of the web of sheet metal between the unstretched leading and trailing portions comprising the metal mesh; and the two precursors comprise a first precursor and a second precursor formed by cutting across the intermediate portion of the web of sheet metal, the first precursor comprising the leading unstretched portion and the second precursor, comprising the trailing unstretched portion, the first and second panels in each of the first and second precursors containing mesh from the intermediate portion of the web of sheet metal.

3. The method according to claim 2, wherein the first and second precursors are cut from the web of sheet metal with the first side panel on each of the first and second precursors aligned with the second side panel on each of the first and second precursors.

4. The method according to claim 1, wherein the part of the bottom panel in each of the folded first and second precursors comprises a bottom panel portion connected to the first side panel.

5. The method according to claim 4, wherein:

folding includes folding the bottom panel portion away from the first side panel to form part of the bottom panel, the part of the bottom panel from each of the first and second folded precursors partly overlapping midway between opposing first sides panels when the first and second precursors are assembled; and the method further comprises forming a joint between the first and second bottom panel parts where they overlap.

6. The method according to claim 5, wherein the joint between the first and second bottom panel parts is embossed.

7. The method according to claim 1 wherein folding further comprises folding one of the one or more solid metal portions outwardly from top edges of the first and second panels and then downwardly to form the portion of the surrounding rim.

8. The method according to claim 7, wherein folding the one of the one or more solid metal portions further comprises forming a hollow channel inside the rim.

9. The method according to claim 1, wherein each of the first and second side panels comprises an upper part adjacent to the rim portion made from the one or more solid metal portions and a lower part that contains metal mesh.

10. The method according to claim 1, wherein the part of the bottom panel comprises a bottom panel portion extending inwardly from the first side panel and joined along one side to a bottom edge of the second side panel with an overlapping joint.

11. A method for use in making containers that comprise sides made at least partly of metal mesh and a surrounding metal rim extending outwardly from the sides not made of mesh, the method comprising:

cutting one or more precursors from a web of sheet metal comprising one or more portions that have been perforated and expanded along an expansion direction to form metal mesh, and one or more unstretched sheet metal portions; and for each of the one or more precursors, folding the precursor to make up in a single piece at least a first side panel for a metal mesh container and an adjacent second side panel for the metal mesh container, and at least a portion of the surrounding metal rim extending outwardly from top edges of the first and second side panels, wherein the first and second side panels are at least partly made of metal mesh at least a portion of the rim joins the first and the second side panels and is formed from one of the one or more unstretched sheet metal portions;

wherein:

the one or more unstretched sheet metal portions comprise an unstretched leading portion and an unstretched trailing portion of the web of sheet metal, with an intermediate portion of the web of sheet metal between the unstretched leading and trailing portions comprising the metal mesh;

the one or more precursors comprise a first precursor and a second precursor formed by cutting across the intermediate portion of the web of sheet metal, the first precursor comprising the leading unstretched portion and the second precursor, comprising the trailing unstretched portion, the first and second panels in each of the first and second precursors containing mesh from the intermediate portion of the web of sheet metal;

each of the first and second precursors further comprises a bottom panel portion connected to the first side panels; and folding includes folding each of the bottom panel portions away from the first side panel, the bottom panel portions from a set of opposing first side panels of the mesh container partly overlapping midway between opposing first sides panels; and wherein the method further comprises forming a joint between the first and second bottom panel portions where the first and second bottom portions overlap.

12. The method according to claim 11, wherein the joint between the first and second bottom panel portions is embossed.

* * * * *